United States Patent [19]

Cohrt

[11] Patent Number: 4,663,933

[45] Date of Patent: May 12, 1987

[54] COMBUSTION INDEPENDENT FROM AMBIENT AIR

[75] Inventor: Claus Cohrt, Sudweyhe, Fed. Rep. of Germany

[73] Assignee: Erno Raumfahrtechnik GmbH, Bremen, Fed. Rep. of Germany

[21] Appl. No.: 802,710

[22] Filed: Nov. 27, 1985

[30] Foreign Application Priority Data

Dec. 1, 1984 [DE] Fed. Rep. of Germany ..... 3443984

[51] Int. Cl.[4] ..... F02K 9/00; C06D 5/00

[52] U.S. Cl. ..... 60/214; 60/216; 60/257

[58] Field of Search ..... 60/257, 211, 214, 216, 60/39.464, 39.461, 39.02

[56] References Cited

U.S. PATENT DOCUMENTS

| | | | |
|---|---|---|---|
| 3,705,495 | 12/1972 | Greimer | 60/214 |
| 4,090,895 | 5/1978 | Outten | 60/216 |
| 4,214,439 | 7/1980 | Browning et al. | 60/257 X |

*Primary Examiner*—Edward G. Favors

*Attorney, Agent, or Firm*—Ralf H. Siegemund

[57] ABSTRACT

A drive aggregate is operated independently from the availability of external air, by using a fuel being composed of a blend of hydrocarbons and metal, e.g. lithium hydrides in a pasty, pumpable, i.e., fluidized, condition, and a metal chlorate, e.g., lithium chlorate or metal perchlorate is used as an oxidizer, having been rendered fluid in a high concentration by the addition of water so that the oxidizer, when decomposing, yields oxygen which combines with hydrogen released from the fuel. Reaction products remain, or are pumped into the tanks or into the ambient sea.

10 Claims, 1 Drawing Figure

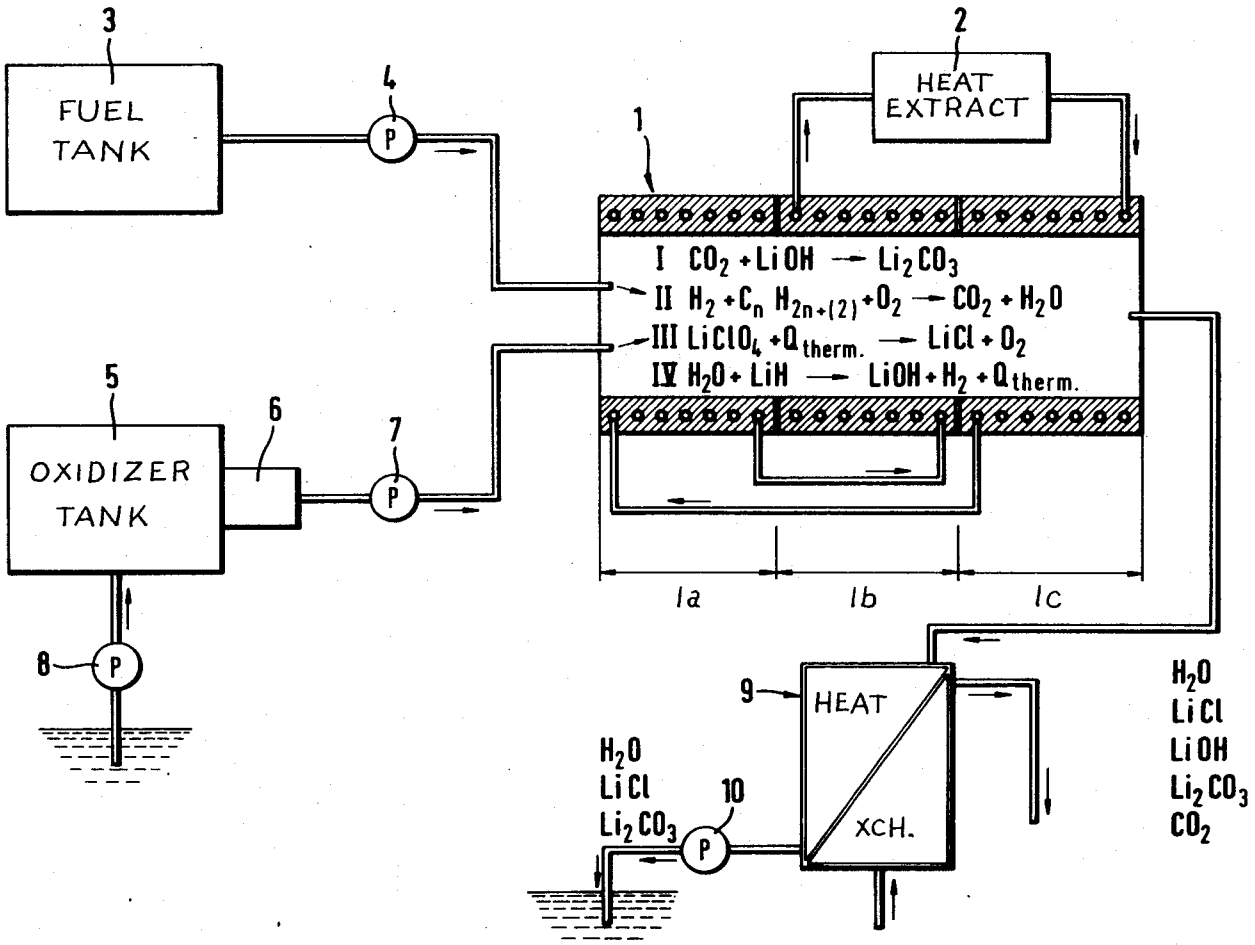
HEAT EXTRACT
2
1
I $CO_2 + LiOH \rightarrow Li_2CO_3$
II $H_2 + C_n H_{2n+(2)} + O_2 \rightarrow CO_2 + H_2O$
III $LiClO_4 + Q_{therm.} \rightarrow LiCl + O_2$
IV $H_2O + LiH \rightarrow LiOH + H_2 + Q_{therm.}$
1a
1b
1c
$H_2O$
LiCl
LiOH
$Li_2CO_3$
$CO_2$
HEAT
XCH.
9
10
P
$H_2O$
LiCl
$Li_2CO_3$
4
7
6
3
FUEL TANK
5
OXIDIZER TANK
8

COMBUSTION INDEPENDENT FROM AMBIENT AIR

BACKGROUND OF THE INVENTION

The present invention relates to the operation of a drive aggregate, or unit, in which a certain fuel is used for combustion under conditions which are independent from the availability of ambient air (oxygen) so that such an aggregate or unit can be particularly used in underwater operation.

Submarines or other underwater vehicles are driven, for example, by electro-engines, or motors or pump-jet drives or on utilization of combustion and/or reaction drives which operate without requiring access to ambient air. For example, German printed patent application No. 24 59 556 discloses a drive for a submarine having a drive turbine which is operated by the catalytic decomposition of hydrazine under utilization of the energy released in a hydrazine-water mixture. Drives of this type are particularly conceived for use in torpedoes and, depending upon design and power, sufficient operating periods and, particularly, operating range for a torpedo can be obtained.

It is inevitable in such a drive that bubbles develop. On the other hand, a successful utilization of torpedoes requires that bubbles are not developed. Therefore, it has been suggested specifically to pump back those gasses which will not go into solution completely in water, under utilization of the compressor whereby, particularly, these gasses will be returned to the hydrazine container.

Aside from the hydrazine-type drive aggregates which do not require external air for the reaction, it is also known to use a solid fuel, for example, lithium aluminum hydride or metals which react with water in a chamber so as to obtain a reaction which yields a sufficient amount of energy. German Printed Patent Application No. 21 27 046 discloses by way of example a particular solid fuel for a drive, but this particular fuel is disadvantaged by a spontaneous reaction capability with water and other oxidizers. Moreover, this particular kind of solid fuel is very difficult to transport and most certainly cannot be pumped, so that the control of such a drive aggregate, as far as the fuel is concerned, depends exclusively on the controlability of the oxidizer.

DESCRIPTION OF THE INVENTION

It is an object of the present invention to provide a new and improved drive aggregate operation, or unit, to be used independent from the availability of external air, particularly oxygen, but using an easily transportable fuel, while the reaction does not produce any gasses that may lead to the formation of bubbles.

In accordance with the preferred embodiment of the present invention, it is suggested to use a fuel being a combination or mixture of hydrocarbons and metal hydrides such as alkali metal hydride and being presented in a pasty, pumpable state or condition, and that the oxidizer is a metal chlorate or a metal perchlorate, the metal being preferably an alkali metal, which is soluble in water and made into an easily transportable fluid material by the adding of water without, however, losing much of the concentration so as to yield oxygen.

The inventive feature provides for a drive aggregate operation which is easily controllable and does not produce gaseous reaction products. The addition of water to the oxidizer triggers a hypergolic ignition with a fuel component within the particular reaction chamber so that, on the basis of that reaction, thermal energy is released which, in turn, releases the oxygen of the chlorate or perchlorate for purposes of reacting with the remaining fuel components. This reaction sequence includes further bonding of carbon dioxide resulting from the reaction of the hydrocarbons with the generated oxygen with the likewise generated alkali metal hydroxide under formation of solid, water-soluble alkali metal carbonate which can be removed or discharged without the formation of an accompanying gas.

In a particular advantageous configuration of the drive aggregate, the reaction chamber may be run with a pressure in excess of the critical pressure of the carbon dioxide while, in addition, the chamber of the aggregate can be cooled either through the working medium of the power producing process or by the ambient water in sub-sea operation or both. Consequently, any carbon dioxide that may form in the gaseous state is actually liquified and comes into close contact with the alkali metal hydroxide which is carried along in the combustion water.

The mixing ratio of the hydrocarbons, the alkali metal hydride, and the oxidizer should be adjusted so that no excess gaseous components such as hydrogen, oxygen, carbon monoxide, dioxide, or gaseous hydrocarbon compounds will be produced. The reaction chamber is preferably constructed so that the reaction products as a result from the reaction remain in the chamber. Alternatively, they may be fed back to occupy the space previously occupied by the fuel in the fuel tanks. Still alternatively, the reaction products should be pumped into the surrrounding sea, the pumping to be carried out carefully so that bubbles will not form.

The transport of the oxidizer under the addition of water is subject to temperature control to thereby control the concentration under further consideration of the extraction of oxidizer solution from the respective storage tank.

DESCRIPTION OF THE DRAWINGS

While the specification concludes with claims particularly pointing out the features which are regarded as the invention, it is believed that the features and objects of the invention, as well as further objects and features, will become more apparent when reference is made to the accompanying drawings in which the FIGURE illustrates somewhat schematically an example for practicing the best mode of the invention in accordance with the preferred embodiment thereof.

Proceeding to the detailed description of the drawings, the inventive drive aggregate, or aggregate system or unit, is comprised of a reaction chamber 1 having a wall structure in which a cooling system is incorporated. In general, the cooling system includes an evaporation zone 1*a*, a superheater 1*b*, and a pre-heating zone 1*c* for the working medium of the heat exchange process carried out in the chamber 2 and by means of which the desired thermal energy is extracted from the system. The fuel needed for operating the drive aggregate is normally stored in a fuel tank or a tank system 3. A fuel pump 4 extracts fuel from the tank 3 and passes it into the reaction chamber 1. Analogously, a tank 5 is provided for holding the oxidizing material, and a pump 7 extracts oxidizer material from the tank 5 and feeds the same also to the reaction chamber 1. The outflow of the oxidizer is subject to a temperature control by an appropriate controller 6.

The oxidizer tank 5 may hold the oxidizer proper in a pasty consistency and, in the normal case, needs water to render the oxidizer sufficiently fluid. Accordingly, a pump 8 is provided to add water from a suitable reservoir to the content of the oxidizer tank 5. The amount of water added should just suffice to obtain the requisite fluidity; the concentration of oxidizing material should be quite high.

The reaction products resulting from a reaction between fuel and oxidizer inside chamber 1 are passed on through a heat exchanger 9 and are further extracted from the heat exchanger 9 through a pump 10. These products are, as is indicated in a general way, discharged as liquidous products into ambient water.

It may be assumed now that this particular drive aggregate, illustrated somewhat schematically only, is used for driving a torpedo. In this case, then, the fuel pump 4 will provide a particular output in terms of throughput. This throughput is matched to the operating conditions by the conversion 2. The material being pumped may be a blend of hydrocarbons and metal compounds, for example, alkali metal hydrides in a pasty, highly viscous consistency, and is pumped in this fashion into the chamber 1. The addition of water to the oxidizer having occurred in tank 5, causes the oxidizer solution as pumped by the pump 7 to trigger a hypergolic ignition. Since fuel and oxidizer are both liquid, these two components of the fuel combination can easily be transported, and can be metered for control of the conversion process 2. The hypergolic ignition of the fuel combination makes it feasible to interrupt the reaction in the chamber 1 and to trigger it anew whenever needed and desired so that the drive aggregate, in fact, can be turned on and off and is thus controllable in this fashion.

The reaction in chamber 1 is illustrated in the drawing by way of legend and involves a fuel blend of hydrocarbons-alkali metal hydride and watery metal (per-) chlorate solution as oxidizer as follows:

| | | |
|---|---|---|
| (1) | $LiH + H_2O$ | $LiOH + H_2 + Q_{therm1}$ |
| (2) | $LiClO_4 + Q_{therm1}$ | $LiCl + O_2$ |
| (3) | $O_2 + H_2 + (CH_n)_m$ | $H_2O + CO_2 + Q_{therm2}$ |
| (4) | $CO_2 + LiOH$ | $H_2O + Li_2CO_3 + Q_{therm3}$ |

From these equations, one can see that in accordance with the reaction 1 hydrogen is formed and will react with the oxygen formed as per the reaction 2 so as to establish simple water as per reaction 3. The lithium hydroxide LiOH, formed in accordance with reaction 1, on the other hand, reacts with the carbon dioxide that was formed pursuant to the reaction 3, pursuant to reaction 4 so that, in total, water and lithium carbonate is produced. Since three of these four reactions are, for all practical purposes, an exothermal one (that means it releases heat), one has, in fact, sufficient heat available for extraction and for running specifically the heat conversion process 2. Moreover, one can see from reactions 1 through 4 that the final reaction products are either solid or liquidous, but not gaseous and, therefore, in total, they fulfill the requirement of a reaction product family which does not include the formation of any gaseous reaction products.

The heat exchanger 9, being fed by the output products of the reaction chamber 1, is preferably cooled with external water in case of an underwater operation, as is the case with a torpedo. On the other hand, that heat exchanger can be eliminated if, in fact, the overall construction is such that heat is discharged through 2 at a sufficient rate and quantity. Alternatively, the residual heat developed by the exothermal processes may conceivably be used otherwise.

The reaction chamber 1 may be operated with a pressure which is above the critical pressure of the carbon dioxide. In addition, of course, in the case of underwater operation as envisioned here, chamber 1 may be cooled additionally by the water surrounding the torpedo. This way, one may even liquify any residual gaseous carbon dioxide. The carbon dioxide may come into intensive contact with solid and water-solved alkali metal hydroxide. Of course, during operation the mixing ratio of hydrocarbons/alkali metal hydride/oxidizer is chosen on a stoichometric basis so that the reaction in chamber 1 will not produce excess gaseous components such as oxygen, hydrogen, carbon dioxide and certain lightweight carbon compounds.

The reaction as carried out in chamber 1 requires for the participants fairly long dwell or residence times, such as several minutes, which, of course, means that intensive cooling of the reaction blend down to environmental temperature guarantees the stability of the reaction products. Any thermally caused dissociation can not occur.

It is feasible to provide the reaction chamber such that the reaction products as produced will remain in situ, i.e., they have a solid and/or solved consistency and remain inside the reaction chamber. After a particular mission, the accumulated reaction products may be eliminated from the reaction chamber by means of cleaning so that reuse is possible. Of course, in case of a torpedo, this situation does not arise. Another possibility is to be seen in pumping the reaction products back into the fuel tank 3 and oxidizer tank 5, particularly for volume compensation of the gradually emptied tank as far as fuel is concerned. Aside from these possibilities, it may be advisable to pump the reaction products without forming bubbles into the environmental water, which will be the case for underwater missions other than torpedo. This is actually shown in the drawing.

For operating the drive aggregate, the oxidizer may be prepared (liquified) inside of the chamber 5 through the adding of water by means of the water pump 8, as was already mentioned above. In this operation, continuing the providing of a solution is maintained during operations. The concentration of the oxidizer will be controlled during operation by means of temperature control, using the output from the tank 5 as the controlling criterion, as is illustrated schematically by the particular placement of the controller 6.

The invention is not limited to the embodiment described above, but changes and modifications thereof not constituting departures from the spirit and scope of the invention are intended to be included.

I claim:

1. Method of operating an underwater drive aggregate, independently from the availability of external air, while only condensible and/or water soluble reaction products obtain, comprising the steps of:

using a fuel being composed of a blend of hydrocarbons and metal hydrides in a pasty, pumpable, i.e., fluidized condition for obtaining easy flowing of fuel;

using metal chlorate or metal perchlorate as oxidizer, having been rendered fluid in a high concentration by the addition of water so that the oxidizer, when decomposing, yields oxygen which combines with hydrogen released from the fuel.

2. Method as in claim 1 wherein the addition of water to the oxidizer, together with the alkali metal hydrate, triggers a hypergolic ignition, being an exothermic process, the released thermal energy causing release of the oxygen from the chlorate or the perchlorate, the oxygen to react with the hydrogen as well as the hydrocarbons.

3. Method as in claim 1, including the step of forming a solid and water soluble alkali metal carbon made from the carbon dioxide that results from oxidation of the hydrocarbons, the carbon dioxide reacting with the alkali metal hydroxide that formed by the reaction of water with alkali metal hydride.

4. Method as in claim 1 and operating the reaction at a pressure level in excess of the critical pressure of the carbon dioxide; and cooling by way of ambient water.

5. Method as in claim 1 the metal hydride being an alkali hydride, and wherein a hydrocarbon-to-alkali metal hydride-to-oxidizer ratio is chosen so that no excess oxygen, hydrogen, carbon oxide, and gaseous hydrocarbons will form.

6. Method as in claim 1 and including the step of retaining in situ solid and/or solved reaction products.

7. Method as in claim 1 and including the step of pumping the reaction product into the fuel and oxidizer tanks for volume compensation.

8. Method as in claim 1 and including the step of pumping the reaction products without forming bubbles into external water.

9. Method as in claim 1 and including the step of adding water to the oxidizer and controlling the amount of added water in dependence upon the temperature of oxidizer of the solution as fed towards reaction.

10. Method as in claim 1 wherein said metal hydrides are alkali metal hydrides, said chlorate or perchlorate being an alkali metal chlorate or perchlorate.

* * * * *